US006341908B1

(12) United States Patent
Johnson

(10) Patent No.: US 6,341,908 B1
(45) Date of Patent: Jan. 29, 2002

(54) METHOD AND APPARATUS FOR CONTROLLING PRINT MEDIA SHAPE DURING MEDIA TRANSPORT

(75) Inventor: Bruce G Johnson, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/584,022

(22) Filed: May 30, 2000

(51) Int. Cl.[7] ..... B65H 5/06

(52) U.S. Cl. ..... 400/624; 400/629; 400/636; 400/642; 347/104; 271/264; 271/265.01; 271/270; 271/272

(58) Field of Search ..... 400/624, 629, 400/634, 635, 636, 642, 616, 616.1; 347/104, 153, 164; 271/258.01, 264, 265.01, 270, 272

(56) References Cited

U.S. PATENT DOCUMENTS

| | | | | | |
|---|---|---|---|---|---|
| 3,844,552 | A | * | 10/1974 | Bleau et al. | 271/245 |
| 4,465,272 | A | * | 8/1984 | Kajita et al. | 271/246 |
| 5,342,133 | A | | 8/1994 | Canfield | 400/635 |
| 5,461,408 | A | | 10/1995 | Giles et al. | 347/102 |
| 5,495,276 | A | | 2/1996 | Mul et al. | 347/164 |
| 5,602,571 | A | * | 2/1997 | Suda et al. | 346/134 |
| 5,789,727 | A | * | 8/1998 | Teradaira et al. | 235/449 |
| 6,092,891 | A | * | 7/2000 | Okubo et al. | 347/104 |

* cited by examiner

*Primary Examiner*—John S. Hilten
*Assistant Examiner*—Kevin D. Williams

(57) ABSTRACT

A method and apparatus is described for feeding a print media through a closed, curved path such that any abrasion of any special coating on the printing surface of the media is prevented. A motor driven pulley subsystem bridging the entrance and exit of the path is selectively adjustable to change the positioning and shape of the media as it passes therethrough.

12 Claims, 4 Drawing Sheets

METHOD AND APPARATUS FOR CONTROLLING PRINT MEDIA SHAPE DURING MEDIA TRANSPORT

BACKGROUND OF THE INVENTION

1. Field of the Invention

The present invention relates generally to print media transport systems and, more specifically, to a method and apparatus for transporting a sheet of print media through a hard copy apparatus transport path with limited surface contact to protect the printing or printed surface.

2. Description of Related Art

Many computer-controlled hard copy printing apparatus are commercially available. Some types are compatible with specially coated media; for example, ink-jet printers use special media to print photographic quality reproductions from digitized photographs. [The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal,* Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions. Ink-jet devices are also described by W. J. Lloyd and H. T. Taub in Output Hartcopy [sic] Devices, chapter 13 (Ed. R. C. Durbeck and S. Sherr, Academic Press, San Diego, 1988). For convenience in describing the art and the present invention, all types of hard copy apparatus are sometimes hereinafter referred to as "printers;" all types, sizes, and compositions of print media are also referred to as "paper;" all compositions of colorants are sometimes referred to as "ink;" and all embodiments of an ink-jet writing instrument are simply referred to as a "pen;" no limitation on the scope of the invention is intended nor should any be implied.

In many printers, the input paper path—that is, the automated, paper—transport path between the input tray where the user stacks sheets of preferred paper for the next printing job and the printing station of the apparatus—is configured to be curvilinear in order to reduce the overall printer footprint. U.S. Pat. No. 5,461,408 (assigned to the common assignee herein and incorporated herein by reference) filed by Giles et al. on Apr. 30, 1993 for a DUAL FEED PAPER PATH FOR INK-JET PRINTER, FIG. 7, demonstrates such a typical system as would be found in a commercial DeskJet™ product by Hewlett-Packard Company. However, contact with stationary printer mechanisms such as guide surfaces in the transport path can damage coatings on the paper printing surface, thus affecting the quality of the printed image. Maintaining a substantially constant tension in a moving sheet of paper presents many problems and can require a complex drive system; see eg., U.S. Pat. No. 5,495,276 filed on Apr. 18, 1994 by Mul et al. (assigned to the common assignee herein) for a UNIFORM MEDIA TENSIONING OF PRINT MEDIA DURING TRANSPORT IN LASER PRINTER.

A common solution in a curvilinear input paper path is to underdrive an upstream set of transport rollers and overdrive a downstream set of transport rollers to relieve the tension during the curved path segment with the sheet moving between guide frames. This type of subsystem adds mechanical and electrical complexity and increases cost of manufacture as separate motors and controls are required to appropriately bend or buckle the media to avoid printing surface contact with a guide frame.

Therefore, there is a need for improved methods and apparatus for moving special media through an input paper path between stationary guide frame members to avoid a friction producing contact between the printing surface of the media and the frame.

SUMMARY OF THE INVENTION

In its basic aspects, the present invention provides a print media transport device including: a curved frame defining a media path therein; mounted with respect to the path, a pair of upstream rollers and a pair of downstream rollers, the upstream pair having one driven roller; a flexible coupling between the one driven roller and a pulley roller of the downstream pair; and a selectively positionable mechanism for changing tension of the flexible coupling such that predetermined shaping and positioning of media is maintained in the path.

In another basic aspect, the present invention provides a method for guiding print media, having a coated printing surface and a non-printing reverse surface, through a curvilinear path without contacting the coated printing surface on stationary mechanisms. The method includes the steps of: receiving a leading edge of a sheet of the media in a nip between an actively driven roller of a first pair of media drive rollers at the ingress of the curvilinear path such that the reverse surface is guided along a curved surface defining the path; receiving the leading edge of the sheet in a nip between a second pair of media drive rollers at the egress of the curvilinear path; and upon receiving the leading edge in the nip between the second pair of media drive rollers, changing the tension of a drive belt to a pulley wheel coupled to the driven roller to underdrive the second pair of media drive rollers such that the sheet is buckled in order to pass through the path without contact of the coated printing surface with any upper curved surface defining the path.

In another basic aspect, the present invention provides a printer having a printing zone therein, including: a supply of sheets of print media; an ink-jet writing instrument mounted for depositing ink on a sheet in the printing zone; and a print media transport device for sequentially delivering picked sheets to the printing zone, the device including a first curved frame member and a second curved frame member defining a curvilinear print media path therebetween, a first set of media drive rollers having a first drive roller and a first pinch roller mounted upstream of the print media path, a second set of media drive rollers having a second drive roller and a second pinch roller mounted downstream of the print media path, a motor coupled one drive roller, a flexible coupling between the first drive roller and the second drive roller, and a selectively positionable mechanism for changing tension of the flexible coupling such that a predetermined buckling of a segment of the print media in the path between the first curved frame member and second curved frame member is maintained wherein there is no contact between a surface of the media to be printed and a surface of either curved frame member.

Some of the advantages of the present invention are:

it simplifies input paper path tension control;

it simplifies the electronic control requirements;

it reduces the number of drive motors required for paper tension control;

it reduces manufacturing complexity and costs; and it is adaptable for use with a duplex path media paper source.

The foregoing summary and list of advantages is not intended by the inventor to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically annotated

DESCRIPTION OF THE PREFERRED EMBODIMENT

Reference is made now in detail to a specific embodiment of the present invention, which illustrates the best mode presently contemplated by the inventor for practicing the invention. Alternative embodiments are also briefly described as applicable.

Figure 1:
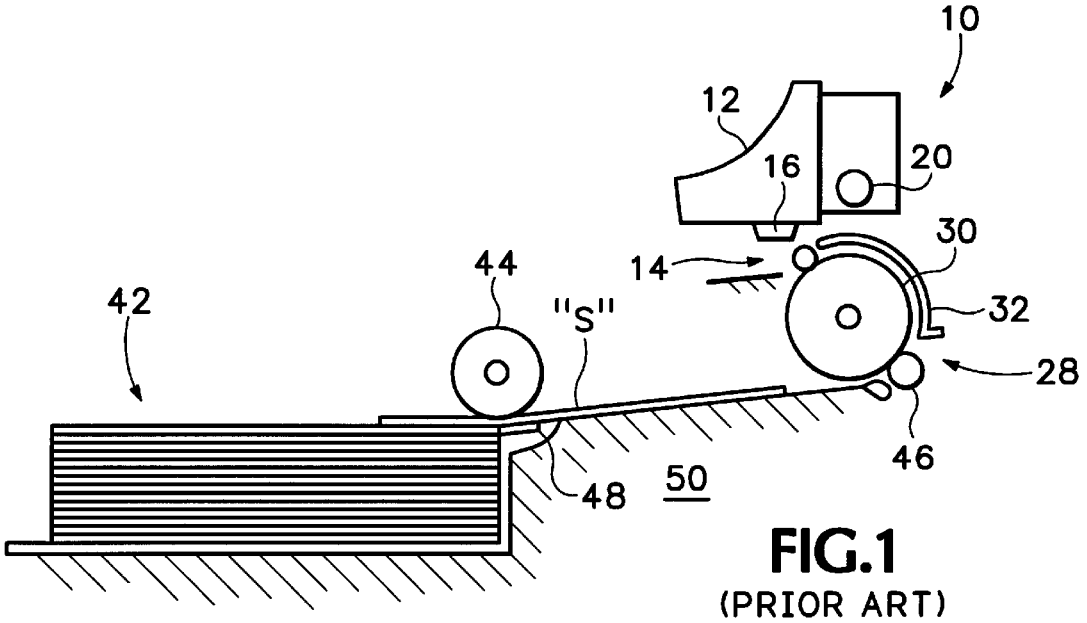
FIG.1 (PRIOR ART)
FIG. 1 (PRIOR ART) is a schematic illustration an ink-jet hard coy apparatus demonstrating a conventional, curvilinear transport path.

FIG. 1 (PRIOR ART) is a schematic depiction of art ink-jet printer apparatus 10. The elements of the apparatus 10 typify an ink-jet printer with a curvilinear input paper path in which the present invention can be employed. Mounted on a rail 20, a scanning ink-jet pen 12 is provided with a printhead 16 having drop generators including nozzles for ejecting ink droplets onto an adjacently positioned print medium, e.g., a sheet "S" of paper from an input tray stack 42 transported through a printing zone 14. A pick roller 44 selects the top sheet "S" of the stack 42. The pick roller 44 transports the sheet "S" unit its leading edge is received in a nip between a pinch roller 46 and drive roller 30 of input transport mechanism 28. The leading edge is directed through the nip and bent upwardly into a guide plate 32 wrapped about a segment of the outer surface of the drive roller 30 where the sheet "S" is curved around to deliver the printing surface to the printing zone 14 adjacent the printhead 16. In general, the drive roller 30 is driven by a stepper motor (not shown) that moves the sheet "S" in precise steps through the printing zone 14 such that the scanning pen 12 can print swaths of ink between steps when the sheet is stationary under the printhead 16. Note that printing surface 48 of the sheet "S" would likely be buckled and have regions in contact with the surface of the guide frame 50 and the inner surface of the guide plate 32. If special, coated paper is being used, surface 48 would likely be abraded and damaged, affecting final print quality.

Figure 2:
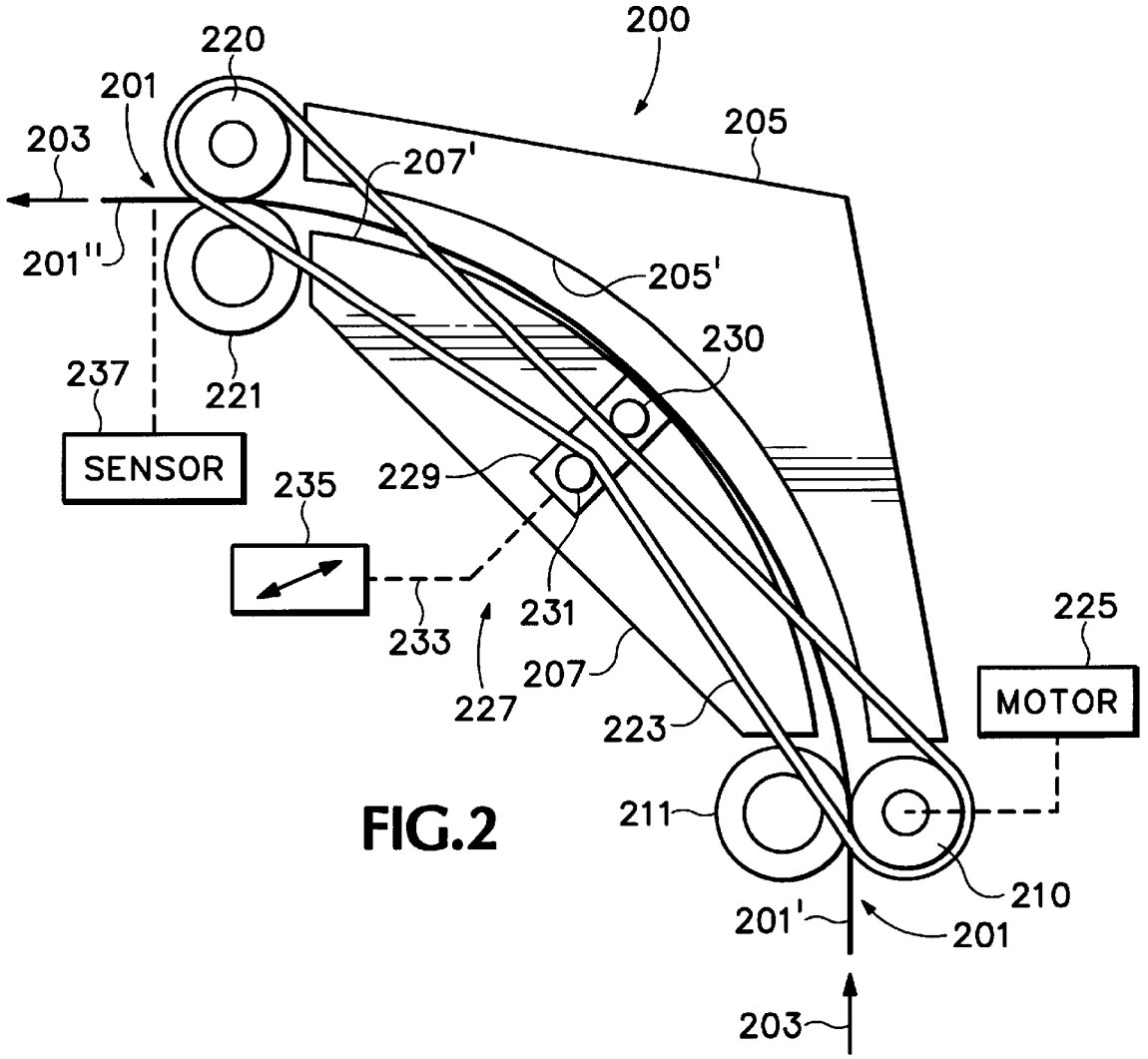
FIG. 2 is a schematic illustration of the present invention in elevation view.
Figure 3:
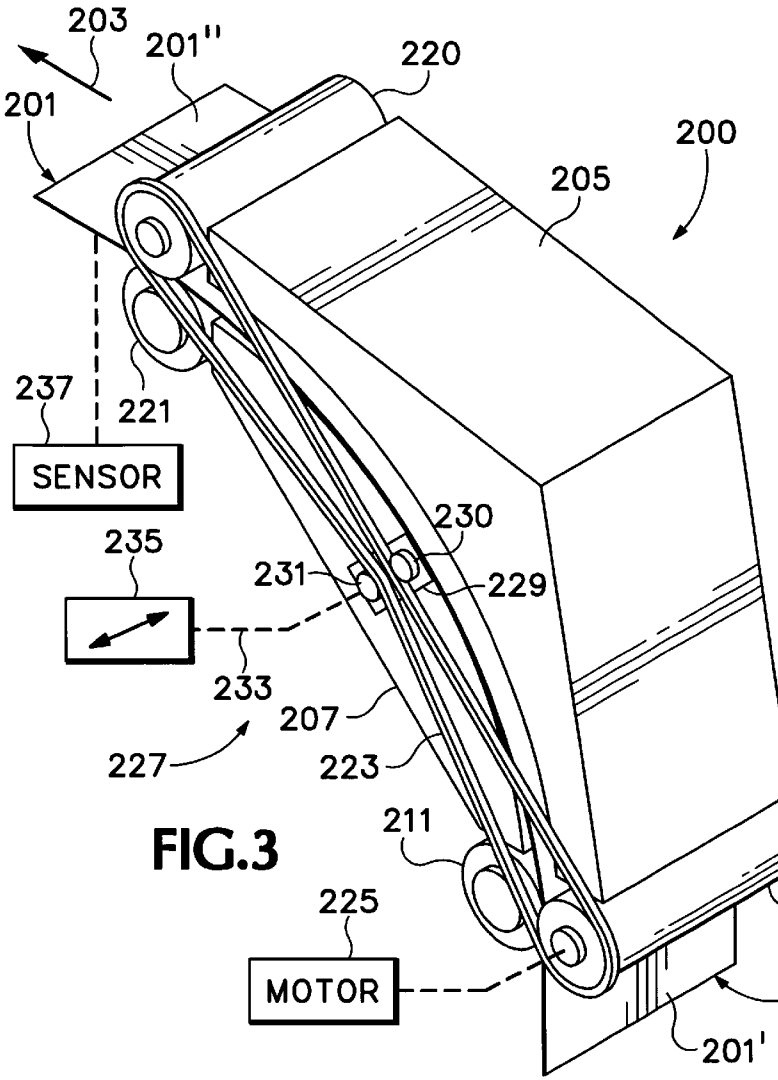
FIG. 3 is a schematic illustration of the present invention as shown in FIG. 2 in perspective view.

FIGS. 2 and 3 depict an input paper path transport mechanism 200 in accordance with the present invention. It is assumed that a known manner pick mechanism is used in conjunction with a stack of paper in an input tray to select a sheet 201 and that the sheet is delivered along the paper path (represented by arrows 203) to the transport mechanism 200 in a manner that will not abrade the paper printing surface 201' on which the ink drops will be deposited. The function of paper path drive elements of the transport mechanism 200 will be to ensure that the paper printing surface 201' does not come into contact with a print media upper guide 205 (compare FIG. 1, guide 32) during the transport of the sheet 201 through the paper path 203 to a downstream printing zone (e.g., FIG. 1, 14). The upper guide 205 has a generally concave surface 205' adjacent the paper path 203. A print media lower guide 207 is positioned adjacently to the upper guide 205. The lower guide 207 has a generally convex surface 207' adjacent the paper path 203.

Generally, the paper path drive elements consist of two pair of rollers utilizing a selectively positionable, flexible coupling, or link, such that only one motor-controlled driven roller is required. More specifically, a first drive roller 210 is paired with a first pinch roller 211 at the upstream extremity of the paper path 203 segment located between the upper and lower guides 205, 207; in other words, appropriately mounted to have roller surface periphery contact within the printer where the sheet 201 enters that path segment. A second drive roller 220 (or "pulley") is paired with a second pinch roller 221 at the downstream extremity of the paper path 203 segment located between the upper and lower guides 205, 207; in other words, mounted in peripheral roller surface contact within the printer where the sheet 201 exits that path segment. It will be recognized by those skilled in the art that print media path directions are relative to a specific printer implementation; for the purpose of describing the present invention, the term "upstream" shall mean toward the paper supply and "downstream" shall mean toward the printing zone. No limitation on the scope of the invention is intended nor should any be implied.

Figure 5:
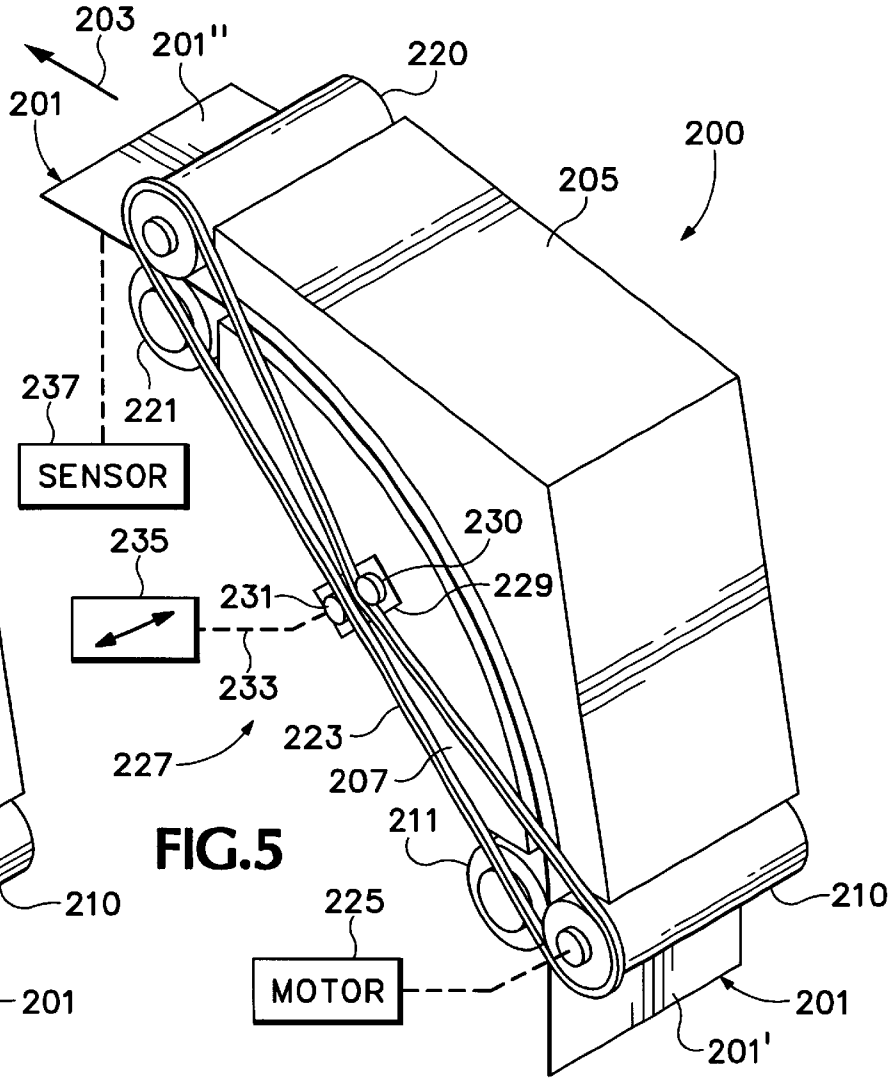
FIG. 5 is a schematic illustration (perspective view) of the present invention as shown in FIG. 4 of the tension governor in a translated position.
Figure 4:
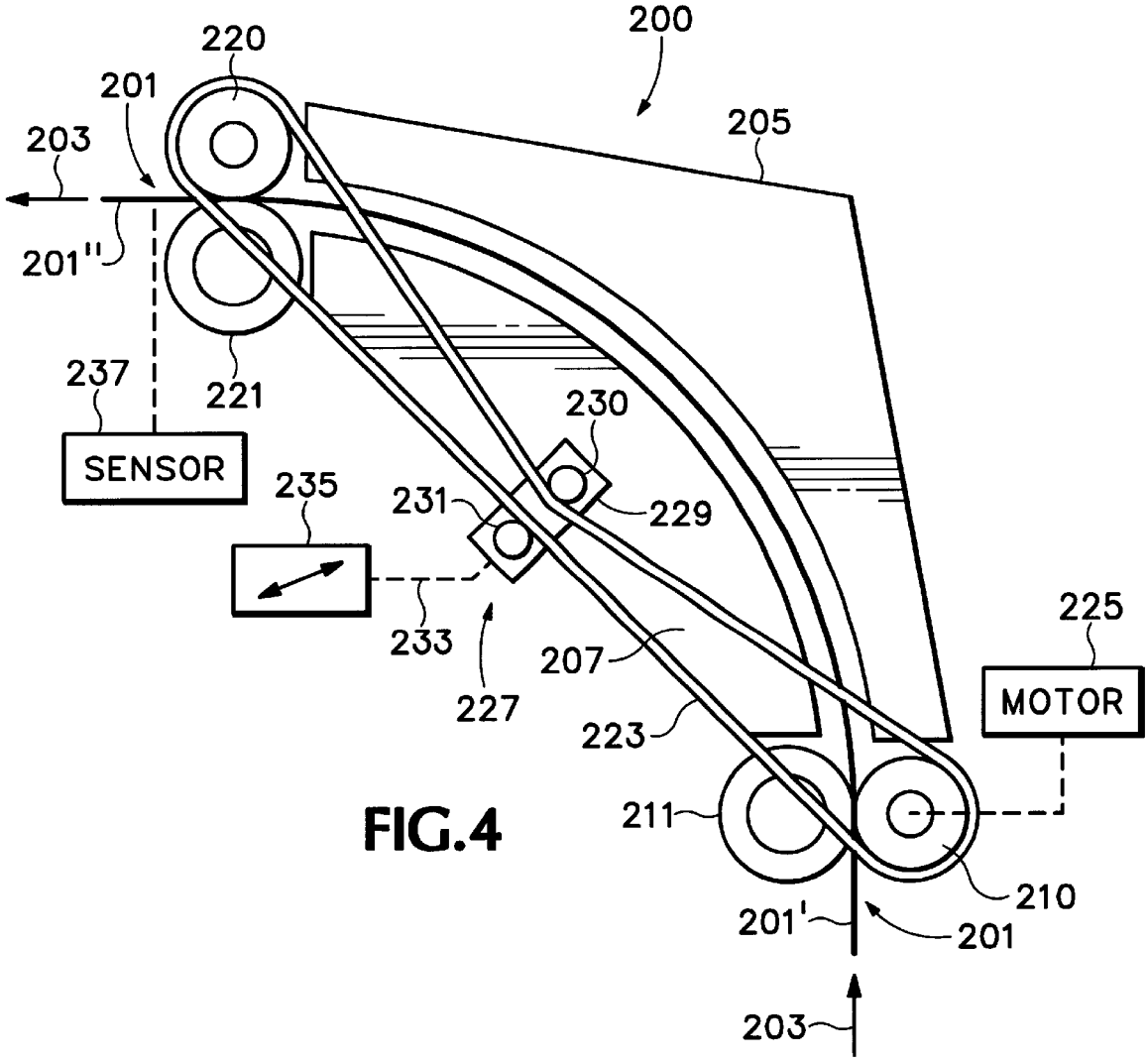
FIG. 4 is a schematic illustration (elevation view) of the present invention as shown in FIGS. 2 and 3 with a tension governor in a translated position.

The two drive rollers 210, 220 are coupled with a flexible link 223—such as a belt, chain, or the like as would be known in the art—such that driving one drive roller with a motor 225 will automatically drive both. In this embodiment the motor 225 is connected to turn the upstream drive roller 210 clockwise. The downstream drive roller 220 is then a pulley wheel. The flexible link 223 is routed through a tension governor 227 device whereby the tension in the link can be selectively changed. The flexible link 223 is provided with extra length beyond that needed merely to couple the upstream drive roller 210 to the pulley-type drive roller 220; the extra length will provide the ability to vary the tension in the link between the two drive rollers 210, 220. The link tension governor 227 has a moving tension governor carriage 229 suitably associated in a known manner to the lower guide 207. One embodiment of link tension governor 227 has two tension rollers: upper tension roller 230 and lower tension roller 231. While a linear motion carriage 229 is demonstrated, it will be recognized by those skilled in the art that a rotary motion or cammed motion implementation can be employed. The carriage 229 is connected 233 in a known mechanical or electro-mechanical manner to a device 235 for selectively positioning the carriage between a media "standard feed" position as shown in FIGS. 2 and 3 and a media "overfeed" position as illustrated in FIGS. 4 and 5. For example, a solenoid device 235 can be employed to select one or the other position. One or both tension rollers 230, 231 are spring-loaded so that as the carriage shifts between the two positions the link 223 will not slip on the driver rollers 210, 220.

Figure 6:
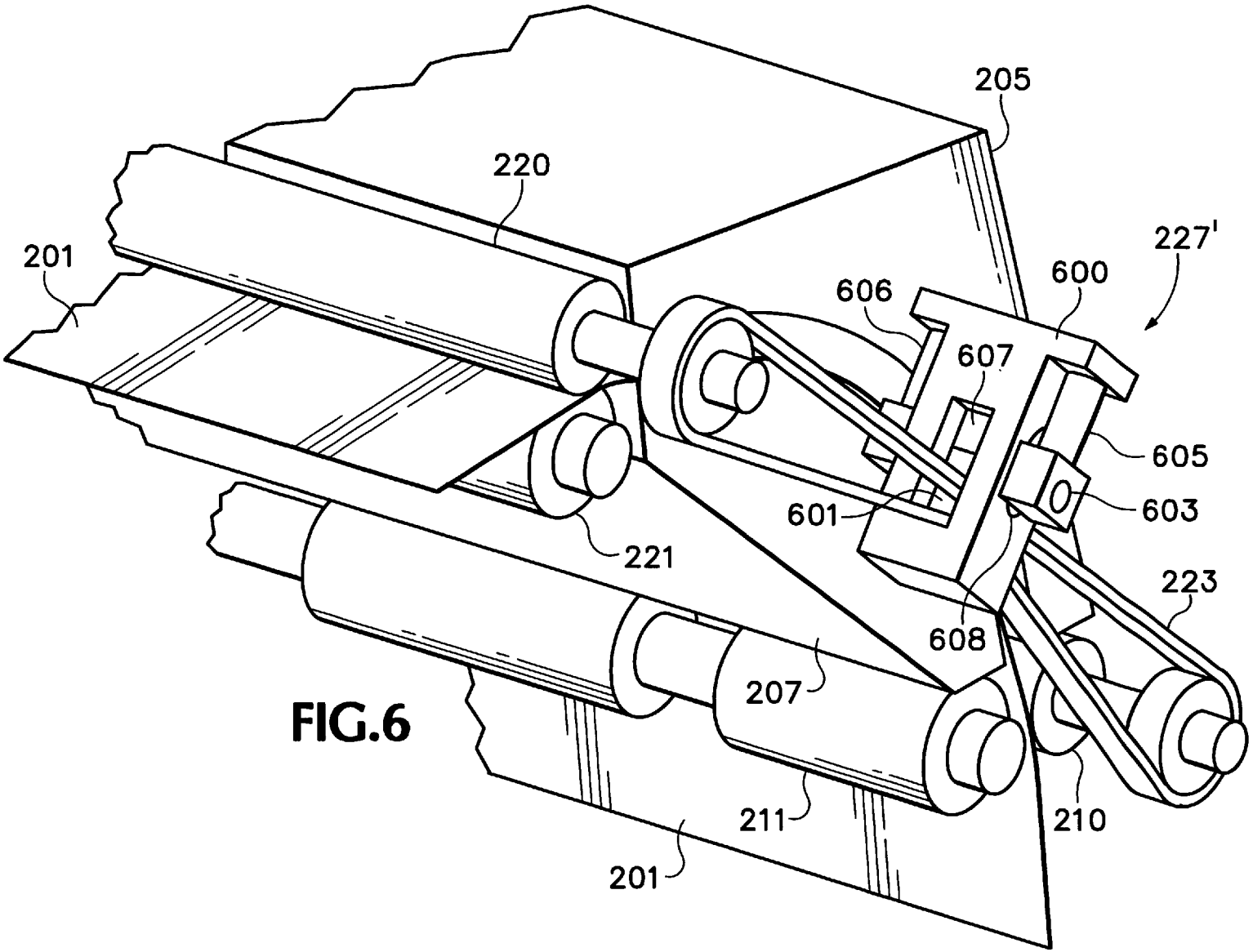
FIG. 6 is a perspective view of the present invention as illustrated in FIGS. 1 and 2 and depicting details of an alternate embodiment of the tension governor.

An alternative embodiment for a tension governor 227' is shown in FIG. 6. The shown position of a guide block 600 used to shift the link 223—in this illustration, an endless loop belt—is substantially identical to that as illustrated in FIGS. 2 and 3. The flexible link 223 passes through an aperture 601 in the guide block 600. A link tension bar 603 bridges the aperture 601. A pair of spring-loaded mounts 605, 606 hold the tension bar 603 in a pair of grooves 607, 608 in the side faces of the guide block 600. So mounted, the outer surface of the bar 603 is in contact with one outer surface of the belt loop as it passes through the aperture 601 while the opposite surface of the belt loop is guided across an opposing inner surface of the guide block 600 within the aperture. The link 223 is thus biased between the bar 603 and the guide block 600. As the solenoid 235 as shown in FIGS. 2–5 shifts the guide block 600 from the first operative position in FIGS. 2, 3 and 6 to the second operative position as shown in FIGS. 4 and 5, the tension bar 603, as biased by the spring-loaded mounts 605, 606, maintains a force (determined by the spring constant) against the belt loop outer surface preventing any slippage of the link 223 between the belt drive rollers 210, 220 while shifting the added length of the link. FIG. 6 also demonstrates a preferred arrangement of the assemblies for print media 201 drive rollers 210, 220 and respective pinch rollers 211, 221.

In operation, during the feed of a next sheet from an input stack (see e.g., FIG. 1) into the paper path 203 segment starting at the nip between the upstream pair of rollers 220, 221 the governor carriage 229 is positioned as shown in FIGS. 2 and 3. Extra length of the link 223 is removed from the drive coupling between the drive rollers 210, 220 by the tensioning contact between the link and the lower tension roller 231 in this "standard feed" position. This will create a slight "underfeeding" of the paper sheet 201 such that the media is guided through the paper path 203 segment between the upper guide 205 and lower guide 207 with the non-printing side of the sheet in contact with the convex surface 207' of the lower guide. This ensures that the printing surface 201' of the sheet 201 does not contact the guides 205, 207 where surface abrasion of media special coatings could occur.

Once the leading edge 201" of the sheet 201 is received in the nip between the downstream pair of rollers 220, 221, a sensor 237 (such as an optical detector, a mechanical flag, a trip switch activated by the paper leading edge, or the like as would be known in the art) triggers the solenoid 235. Via the solenoid 235 action, the governor carriage 229 is translated to a position as shown in FIGS. 4 and 5. In other words, the tensioning of the link 223 is moved from the lower tension roller 231 to the upper tension roller 230. As the translation occurs, the extra link length is moved from the bottom of the link (as shown in FIGS. 2–3) to the top. The movement of the extra link length to the top slows the rotation of the downstream pair of rollers 220, 221 and therefore generates a buckle in the sheet 201, positioning it to be substantially free of contact with either guide 205, 207. In other words, the sheet now captured by both sets of rollers is slightly overfed into the paper path segment between the guides. Thus, it can be recognized that the extent of the buckling to achieve this positioning is a function of the amount of extra link length added by moving the tension governor 227 to the second position.

Once the trailing edge of the sheet is passed through the upstream roller pair nip, the tension governor carriage 229 can be returned to the first position as demonstrated by FIGS. 2 and 3 as the weight of the paper will generally cause it to fall against the lower guide 207. However, this would require a second sensor proximate the upstream roller pair nip.

The present invention this provides a method and apparatus for feeding a print media through a closed, curved path such that any abrasion of any special coating on the printing surface of the media is prevented. A motor driven pulley subsystem bridging the entrance and exit of the path is selectively adjustable to change the positioning and shape of the media as it passes therethrough.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one an only one" unless explicitly so stated, but rather means "one or more,". Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . "

What is claimed is:

1. A print media transport device comprising:

a curved frame defining a media path therein;

mounted with respect to the path, a pair of upstream rollers and a pair of downstream rollers, the upstream pair having one driven roller, the downstream pair having one pulley roller;

a flexible coupling between the one driven roller and the pulley roller of the downstream pair;

a selectively positionable mechanism for changing tension of the flexible coupling such that predetermined shaping and positioning of media is maintained in the path, wherein the selectively positionable mechanism is movable between a first position in which the media is underfed through the path and a second position in which the media is overfed through the path wherein a printing surface of the media does not contact the frame in either position;

a movable carriage mounted to the frame adjacently to a bottom of the path; and a set of tension rollers mounted to the carriage such that the flexible link is routed between the tension rollers and the link is in tensioning contact with one of the tension rollers in the first position and the other of the tension rollers in the second position wherein tension of the media in the path is relaxed.

2. The device as set forth in claim 1, comprising:

the predetermined shaping and positioning of media is a buckling of a segment of the media captured in the path between the pair of upstream rollers and the pair of downstream rollers respectively wherein amount of buckling is a function of an amount of shiftable link length provided in the flexible coupling.

3. A method for guiding print media, having a coated printing surface and a non-printing reverse surface, through a curvilinear path without contacting the coated printing surface on stationary mechanisms, the method comprising:

receiving a leading edge of a sheet of the media in a nip between an actively driven roller of a first pair of media drive rollers at the ingress of the curvilinear path such that the reverse surface is guided along a curved surface defining the path;

receiving the leading edge of the sheet in a nip between a second pair of media drive rollers at the egress of the curvilinear path; and upon receiving the leading edge in the nip between the second pair of media drive rollers, changing tension of a drive belt to a pulley wheel coupled to the driven roller to underdrive the second pair of media drive rollers such that the sheet is buckled in order to pass through the path without contact of the coated printing surface with any upper curved surface defining the path.

4. The method as set forth in claim 3, the step of changing the tension comprising the step of:

changing effective driving length of the belt between the drive roller connected to the motor and the pulley wheel.

5. A printer having a printing zone therein, comprising:

a supply of sheets of print media;

an ink-jet writing instrument mounted for depositing ink on a sheet in the printing zone;

a print media transport device for sequentially delivering picked sheets to the printing zone, the device including a first curved frame member and a second curved frame member defining a curvilinear print media path therebetween, a first set of media drive rollers having a first drive roller and a first pinch roller mounted upstream of the print media path, a second set of media drive rollers having a second drive roller and a second pinch roller mounted downstream of the print media path, a motor coupled to one drive roller, a flexible coupling between the first drive roller and the second drive roller, and a selectively positionable mechanism for changing tension of the flexible coupling such that a predetermined buckling of a segment of the print media in the path between the first curved frame member and second curved frame member is maintained wherein there is no contact between a surface of the media to be printed and a surface of either curved frame member;

a movable carriage mounted to the curved frame member adjacent to a bottom of the path; and a set of tension rollers mounted to the carriage such that the flexible link is routed between the tension rollers and the link is in tensioning contact with one of the tension rollers in the first position and the other of the tension rollers in the second position wherein tension of the media in the path is altered.

6. The printer as set forth in claim 5, comprising:

the drive roller not coupled to the motor is a pulley wheel coupled by the flexible coupling to the drive roller coupled to the motor.

7. The printer as set forth in claim 5, comprising:

the predetermined shaping and positioning of media is a buckling of a segment of the media captured in the path between tension rollers wherein an amount of buckling is a function of an amount of extra link length provided in the flexible link wherein the extra link length is shifted by moving between the first position and the second position.

8. The printer as set forth in claim 5, comprising:

the flexible coupling has a length such that the moving the selectively positionable mechanism between the first position and the second position when a sheet is captured by both the first set and the second set of drive rollers forces a predetermined buckling of a segment of the media in the path wherein the extent of the buckling is a function of length change of flexible coupling between the first set of drive rollers and the second set of drive rollers.

9. The printer as set forth in claim 5, comprising:

moving the selectively positionable mechanism between the first position and the second position changes the flexible coupling tension between the first drive roller and the second drive roller.

10. The printer as set forth in claim 5, comprising:

the second drive roller is coupled to the motor; and the first drive roller is a pulley.

11. The printer as set forth in claim 5, the selectively positionable mechanism further comprising:

a guide block having an aperture for receiving the link therethrough, and a spring-loaded tensioning bar bridging the aperture such that the link is releasably pinched between the bar and an inner surface of the block within the aperture such that the link circulates through the aperture with a tension governed by the position of the block.

12. A printer having a printing zone therein, comprising:

a supply of sheets of print media;

an ink-jet writing instrument mounted for depositing ink on a sheet in the printing zone;

a print media transport device for sequentially delivering picked sheets to the printing zone, the device including a first curved frame member and a second curved frame member defining a curvilinear print media path therebetween, a first set of media drive rollers having a first drive roller and a first pinch roller mounted upstream of the print media path, a second set of media drive rollers having a second drive roller and a second pinch roller mounted downstream of the print media path, a motor coupled to one drive roller, a flexible coupling between the first drive roller and the second drive roller, and a selectively positionable mechanism for changing tension of the flexible coupling such that a predetermined buckling of a segment of the print media in the path between the first curved frame member and second curved frame member is maintained wherein there is no contact between a surface of the media to be printed and a surface of either curved frame member; and the selectively positionable mechanism further including a guide block having an aperture for receiving the link therethrough, and a spring-loaded tensioning bar bridging the aperture such that the link is releasably pinched between the bar and an inner surface of the block within the aperture such that the link circulates through the aperture with a tension governed by the position of the block.

* * * * *